US005787746A

United States Patent [19]

Ferreira

[11] Patent Number: 5,787,746

[45] Date of Patent: Aug. 4, 1998

[54] MULTI-STAND HOT ROLLING MILL TENSION AND STRIP TEMPERATURE MULTIVARIABLE CONTROLLER

[75] Inventor: Adriano M. P. Ferreira, Bridgeport, W. Va.

[73] Assignee: Alcan Aluminum Corporation, Cleveland, Ohio

[21] Appl. No.: 279,519

[22] Filed: Jul. 25, 1994

[51] Int. Cl.[6] ..... B21B 37/74

[52] U.S. Cl. ..... 72/11.3; 72/11.4; 72/8.5; 72/12.2

[58] Field of Search ..... 72/8–13, 234, 72/235, 365.2, 366.2, 201, 200, 202

[56] References Cited

U.S. PATENT DOCUMENTS

| | | | |
|---|---|---|---|
| 3,820,366 | 6/1974 | Smith, Jr. | 72/13 |
| 4,261,190 | 4/1981 | Fapiano | 72/205 |
| 4,274,273 | 6/1981 | Fapiano et al. | 72/201 |
| 5,054,302 | 10/1991 | Yamashita et al. | 72/16 |
| 5,375,448 | 12/1994 | Katayama et al. | 72/8 |
| 5,461,894 | 10/1995 | Sörgel | 72/9.2 |
| 5,479,803 | 1/1996 | Imanari | 72/205 |

FOREIGN PATENT DOCUMENTS

| | | | |
|---|---|---|---|
| 1156329 | 11/1993 | Canada | 72/365.2 |
| 0391658 | 10/1990 | European Pat. Off. | 72/365.2 |
| 4213381 | 7/1967 | Japan | 72/13 |
| 0084215 | 6/1980 | Japan | 72/13 |
| 0139420 | 8/1982 | Japan | 72/12 |
| 0023509 | 2/1983 | Japan | 72/13 |
| 0045884 | 9/1988 | Japan | 72/365.2 |
| 0233004 | 9/1989 | Japan | 72/13 |
| 5337529 | 12/1993 | Japan | 72/12.3 |
| 67820 | 1/1994 | Japan | 72/12.3 |
| 6182415 | 7/1994 | Japan | 72/12.2 |
| 0498046 | 1/1976 | U.S.S.R. | 72/366.2 |
| 0662179 | 4/1979 | U.S.S.R. | 72/13 |
| 0995945 | 2/1983 | U.S.S.R. | 72/13 |
| WO 94/00255 | 1/1994 | WIPO | 72/7 |

*Primary Examiner*—Lowell A. Larson
*Assistant Examiner*—Ed Tolan
*Attorney, Agent, or Firm*—Cooper & Dunham LLP

[57] ABSTRACT

A multivariable controller for a hot rolling mill which uses rolling stand speeds to control exit strip temperature and interstand tension, wherein the controller considers the inherent multivariable nature of the tension and temperature processes relative to individual rolling stand speeds by employing a cross-correlation transfer function matrix which is decoupled by modern control methods to yield more robust, stabler and faster control loops, thereby reducing disturbances and improving product quality.

10 Claims, 5 Drawing Sheets

| | Tension Between Stand 12 And Stand 14 | Tension Between Stand 14 And Reel | Exit Coil Temperature |
|---|---|---|---|
| Reel Speed (82) | $\frac{6e^{-5s}}{(s+2)}$ | $\frac{4.1}{(s+5)}$ | $\frac{0.1}{(s+2)}$ |
| Speed (Stand 14) | $\frac{1}{(s+3)}$ | $\frac{2e^{-s}}{(s+1)}$ | $\frac{1}{(s+2)}$ |
| Speed (Stand 12) | $\frac{1}{(s+1)(s+2)}$ | $\frac{e^{-s}}{(s+1)^2}$ | $\frac{10e^{-s}}{(s+5)}$ |

80

81

$$\begin{bmatrix} & & \\ & K & \\ & & \end{bmatrix} \begin{bmatrix} & & \\ & G & \\ & & \end{bmatrix} \begin{bmatrix} Y_0 \\ Y_1 \\ Y_2 \end{bmatrix} = \begin{bmatrix} Z_0 \\ Z_1 \\ Z_2 \end{bmatrix}$$

$$\begin{bmatrix} & & \\ & G & \\ & & \end{bmatrix} \left( \begin{bmatrix} & & \\ & P & \\ & & \end{bmatrix} \begin{bmatrix} Y_0 \\ Y_1 \\ Y_2 \end{bmatrix} \right) = \begin{bmatrix} Z_0 \\ Z_1 \\ Z_2 \end{bmatrix}$$

FIG. 6

MULTI-STAND HOT ROLLING MILL TENSION AND STRIP TEMPERATURE MULTIVARIABLE CONTROLLER

FIELD OF THE INVENTION

This invention relates to multivariable controllers for controlling the operation of a rolling mill, and more particularly to multivariable controllers wherein the exit temperature of the material being rolled is maintained at a desired temperature setpoint.

BACKGROUND OF THE INVENTION

A typical hot aluminum rolling mill has multiple rolling stands for successively reducing the thickness of a metal strip. Each rolling stand works the strip by compressing the metal strip and by propelling the strip through the stand rollers. Each rolling stand operates at a speed determined by a respective single variable controller.

According to U.S. Pat. No. 3,820,366 (Smith), single variable controllers typically are generic proportional-integral (PI) or proportional-integral-derivative (PID) controllers. These generic controllers receive a "setpoint" command signal, a detected signal measuring some parameter and generate drive signals. Typically, these signals are voltages. Each controller is "programmed" or "tuned" to manipulate the drive signal for the device being controlled so that the detected signal is maintained in a predetermined relationship with the set point command signal in order to "close the loop".

A single variable controller in a traditional rolling mill can be used to detect tension between a rolling stand and the next successive rolling stand (also known as interstand tension), or between a rolling stand and another piece of rolling mill equipment to control the speed of the rolling stand. The tension controller receives a difference signal which is calculated from a commanded speed signal and a detected tension signal. The tension controller then outputs drive commands to the rolling stand in accordance with the controller's programming. Typically, the encoded program is designed to maintain a desired interstand tension despite changes in the commanded speed.

A single variable controller can also use the detected temperature of the metal strip being wound into a coil by a coiling device after the last rolling stand has completed its operation to control the speed of the coiling device. This temperature is also known as the "exit coil temperature." Similar to the tension controller, the temperature controller outputs commanded speed signals to drive the coiling device in accordance with a program to achieve or maintain the desired exit coil temperature.

However, in a typical rolling mill, these single variable controllers operate independently. When the coiling device is driven according to speed commands from the temperature controller calculated to achieve a desired exit coil temperature, the tension between the last rolling stand and the coiling device changes because both the exit coil temperature and the tension are affected by the speed of the coiling device. This change in tension is detected by the tension sensor for the last rolling stand which sends a detected tension signal to the tension controller. The tension controller in accordance with its programming outputs drive commands to adjust the speed of the last rolling stand to maintain the desired tension. This speed change to correct the tension will affect the exit coil temperature. The temperature controller must then compensate for the tension change by adjusting the speed commands for the coiling device which again affects the tension. This cycle repeats until each controller has "settled," that is, adapted to the changes made by the other controller. Accordingly, there is a delay or settling time before a stable desired exit coil temperature is achieved.

Furthermore, since the tension controllers in the mill are independent, the speed of the rolling stand which precedes the last rolling stand is not adjusted to compensate for the faster or slower speed of the last rolling stand until the preceding rolling stand's tension sensor detects a change in the interstand tension between the preceding rolling stand and the last rolling stand. Since the speed of the preceding rolling stand also affects the metal strip temperature, the adjustment to the preceding rolling stand's speed to maintain desired interstand tension with the last rolling stand requires the last rolling stand to compensate for this additional change in temperature after detection by the exit coil temperature sensor. This cycle continues until each controller settles to a stable state. Similarly, other rolling stands in the mill are affected by the adjustment of the exit coil temperature and the subsequent changes caused thereby. Therefore, the exit coil temperature is affected by the speed of all the rolling stands in the mill and the exit coil temperature adjustment is delayed until all the interstand tension disturbances caused by the adjustment are corrected. Thus, the delay for achieving the desired exit coil temperature is multiplied as the changing speeds of the rolling stands echo back through the successive rolling stands because each preceding rolling stand must first sense a tension change and then adjust the rolling speed to maintain the desired tension. Accordingly, the exit coil temperature control loop reacts slowly and the desired exit coil temperature may not be achieved until as much as 45 seconds after a temperature change is first commanded.

Additionally, since speed changes also modify the amount of "work" being put into the strip, the effect on other actuators, such as screwdowns, and their corresponding controllers in the rolling mill may be disturbed by the speed changes. These disturbances also can echo back to the first rolling stand. Since the amount of work affects the quality of the metal strip, the temperature control loop must "wait" for these additional disturbances in the rolling mill to be corrected. Accordingly, there is an even greater delay before a metal strip of the desired quality can reach the temperature sensor to be measured and an assessment of the adjustment of the exit coil temperature can be made.

SUMMARY OF THE INVENTION

The present invention solves the problems discussed above by providing a multivariable controller which adjusts the commanded speed of each of the rolling stands in the rolling mill according to a target exit coil temperature and corresponding target interstand tensions. Specifically, the controller considers the inherent multivariable nature of the relationship between the interstand tensions and the temperature processes relative to the rolling speeds of individual stands and generates a command speed signal for each of the rolling stands and the coiling device.

In one embodiment, the multivariable relationship is represented as a transfer function matrix. In order to generate the separate command speed signals, the transfer function matrix is manipulated to be diagonally dominant to "decouple" the cross-correlations of the transfer function matrix thereby yielding more robust, stabler and faster control loops which reduce disturbances and improve the product quality.

Also, the present invention discusses a rolling mill or a control system for a rolling mill for processing a web of material having devices for successively reducing the thickness of the web of material; detectors for measuring parameters of the rolling mill operation and for generating detected parameter signals; single variable controllers for generating drive command signals for each manipulating device according to the detected parameter signals; and a multivariable controller: (1) for receiving the drive command signals; (2) for adjusting the drive command signals according to predetermined relationships between the detected parameter signals and the drive command signals; and (3) for outputting the adjusted drive command signals to the manipulating devices.

The single variable controllers discussed above can include speed controllers for generating speed drive command signals for the manipulating devices. Also, the manipulating devices can include rolling stands for successively reducing the thickness of the web of material in accordance with the adjusted drive command signals and a coiling device for winding the manipulated web of material into a coil also in accordance with the adjusted drive command signals.

Detected parameter signals of the present invention can include detected interdevice tension signals measured between the manipulating devices and a detected temperature signal of the web of material. The detected temperature signal can be measured between the last one of the rolling stands in the mill and the coiling device.

The predetermined relationships of the present invention can be represented in a diagonally dominant matrix having rows and columns, each row's elements representing respective relationships between one drive command signal and one detected parameter signal.

An optimizer for adjusting the drive command signals in accordance with mechanical limitations of the manipulating devices can be included in the multivariable controller.

Also, the present invention includes a method for controlling the temperature of a web of material at a location along the processing path of the web of material in a rolling mill where the processing path includes manipulating devices which affect the interdevice tension and web of material temperature. The steps of this method include: (1) generating drive command signals for the manipulating devices according to setpoint command signals and detected parameter signals where at least one of the drive command signals are generated from a web of material temperature setpoint command signal and a detected web of material temperature signal; (2) adjusting the drive command signals according to a predetermined relationship which relates the detected parameter signals to each of the drive command signals; and (3) outputting the adjusted drive command signals to the manipulating devices.

Additionally, the present invention includes a method for maximizing the decoupling of the interrelationships between devices in a rolling mill by: (1) determining elements of a transfer function matrix having rows and columns for modelling the operation of the rolling mill when each row has elements that relate detected controlled parameter signals to one generated manipulated parameter signal; (2) by manipulating the transfer function matrix to generate a diagonally dominant transfer function matrix and, then, a pre-multiplier matrix; and (3) by encoding the pre-multiplier matrix in a multivariable controller. The multivariable controller adjusts drive commands for each device to decouple the interrelationships between the devices. This method also can include the steps of: (1) gathering data for each element of the transfer function matrix by varying one of the manipulated parameter signals while keeping other manipulated parameter signals constant and measuring the effect of the variation on the controlled parameter signals to generate a model of a relationship between each of the manipulated parameter signals and each of the controlled parameter signals; and/or (2) optimizing allowed regions of operation of each device in accordance with the physical limitations of each device.

BRIEF DESCRIPTION OF THE DRAWINGS

Further objects, features and advantages of the invention will become apparent upon review of the following detailed description of the preferred embodiments, taken in conjunction with the following drawings in which:

FIG. 6 is a mathematical diagram illustrating the matrix and vector equations in accordance with the embodiment in FIG. 1.

DETAILED DESCRIPTION OF THE PREFERRED EMBODIMENTS

Figure 1:
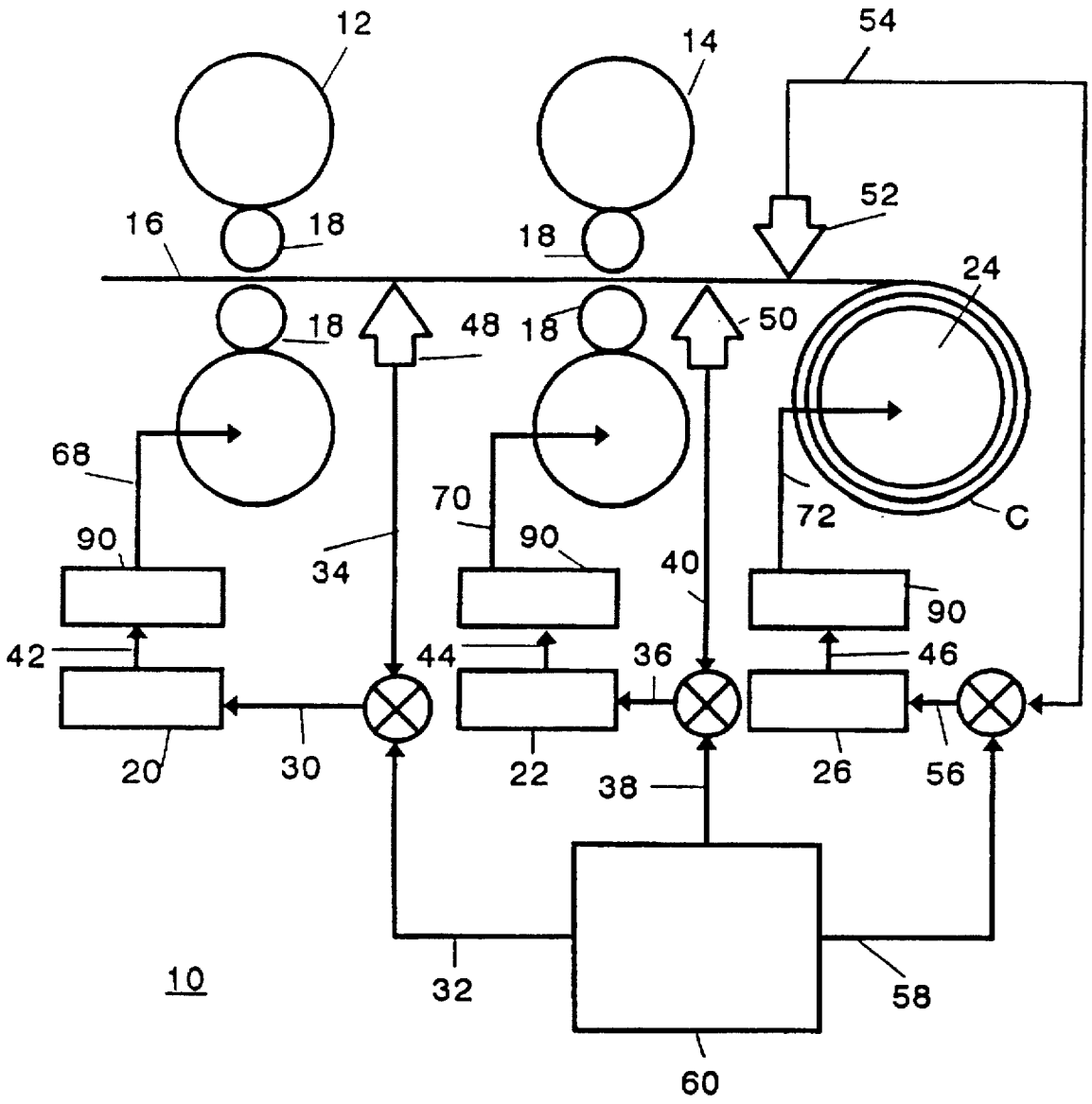
FIG. 1 illustrates a rolling mill employing single variable controllers and a multivariable controller in accordance with a first embodiment the subject invention.

FIG. 1 illustrates an improved rolling mill operation in accordance with a preferred embodiment of the subject invention for reducing the thickness of a continuous or discontinuous sheet of material. For example, and for the purposes of the present discussion, the method and apparatus of the present invention will be discussed with reference to an aluminum or aluminum alloy rolling mill, but both the method and apparatus can be used or adapted to other rolled sheet materials such as steel or other metals. This improved rolling mill 10 in its basic configuration includes at least two rolling stands 12, 14 and a coiling device 24. Each rolling stand 12, 14 reduces the thickness of a metal strip 16 (or other web of material undergoing thickness reduction) by compressing the metal strip 16 as it passes between the rollers 18 of the particular rolling stand 12, 14. Tension sensors 48, 50 are located between the rolling stands 12, 14 and between the last rolling stand 14 and the coiling device 24, for example, a reel. The tension sensors 48, 50 detect the interstand tensions and generate respective detected, interstand tension signals 34, 40. A temperature sensor 52 is located between the last rolling stand 14 and the coiling device 24 to detect the exit coil temperature and to generate a detected exit coil temperature signal 54, as the strip 16 moves from left to right and is wound into a coil C.

A respective difference signal 30, 36, 56 is generated from each of the detected interstand tension signals 34, 40 and the detected exit coil temperature signal 54 relative to a corresponding setpoint command signal 32, 38, 58. The rolling mill 10 generates the setpoint command signal, for example, from a separate setpoint command signal generator (not shown) or from a rolling mill controller 60. The respective difference signals 30, 36, 56 are received by respective single variable controllers 20, 22, 26. In the embodiment illustrated in FIG. 1, the difference between the first detected tension signal 34, which is sensed between the rolling stands 12, 14, and the setpoint command signal 32, is determined or calculated for the single variable controller 20 which manipulates the speed of the first rolling stand 12. Similarly, the difference between the second detected tension signal 42, which is sensed between the second rolling stand 14 and the reel 24, and the setpoint command signal 38 is determined or calculated for the single variable controller 22 which manipulates the speed of the second rolling stand 14. Likewise, the difference between the detected exit temperature signal 54, which is sensed between the second rolling stand 14 and the reel 24, and the setpoint command signal 58 is determined or calculated for the single variable controller 26, which manipulates the speed of the reel.

Each output drive signal 42, 44, 46 from each single variable controller is received by a multivariable controller or pre-compensator 90 which dynamically precompensates for the interrelationships between the rolling mill devices. The multivariable controller 90 is shown as three separate units in FIG. 1, but the multivariable controller also can be a single unit. The precompensation is performed by adjusting the drive signals in the multivariable controller and by generating adjusted drive signals 68, 70, 72. As described more fully below, the precompensation can be, for example, mathematical manipulation in a digital computer which receives the output drive signals as digital data, multiplies this data by a precompensator matrix which relates the output drive signals to each other according to the interrelationships between the rolling mill devices, and which generates the adjusted drive signals as digital data. If necessary, analog-to-digital converters and digital-to-analog converters could be used if the sources and/or destinations of the drive signal are analog. Of course, analog computers and/or hardwired circuitry could also be employed to perform the precompensation. Each of the adjusted drive signals 68, 70, 72 then are received by the respective corresponding device 12, 14, 24 which is operated in accordance with the adjusted drive signal.

In this way, the multivariable controller 90 calculates the appropriate adjusted drive signal 68, 70, 72 for each rolling stand 12, 14 and for the reel 24 according to the known interrelationships of the interstand tensions and exit coil temperature. Accordingly, each rolling stand 12, 14 and the reel 24 are driven directly to stable commanded speeds by the multivariable controller 90, instead of indirectly by each single variable controller separately detecting changes in its measured variable and then adjusting the drive command signal accordingly. Therefore, stability is achieved more rapidly.

Although the relationship information can be determined in other ways, for example, from the specifications provided by rolling stand manufacturers, the interrelationships can be determined more easily by experimentation in a particular rolling mill.

The data for the known interrelationships is gathered beforehand by measuring the interstand tensions and the exit coil temperature for various combinations of the manipulated variables or parameters. Each manipulated variable is changed separately while the other manipulated variables are held constant and the controlled variables are measured. For example, to develop the interrelationships for the reel speed, the interstand tensions and exit coil temperature can be measured for strip manipulating device speeds 10, 20, 30; 10, 20, 40; 10, 20, 50; and so forth, where the first number in each group represents the first rolling stand speed, the second number represents the second rolling stand speed and the third number represents the reel speed, respectively. From these measured results a characteristic relationship for each manipulated variable can be derived by well-known modelling techniques. For the embodiment illustrated in FIG. 1, each of the three manipulated variables, that is, the speeds, affects each of the three controlled variables. Accordingly, nine mathematical models are used to provide a description of the interrelationships between the rolling mill equipment.

Figures 2, 3:
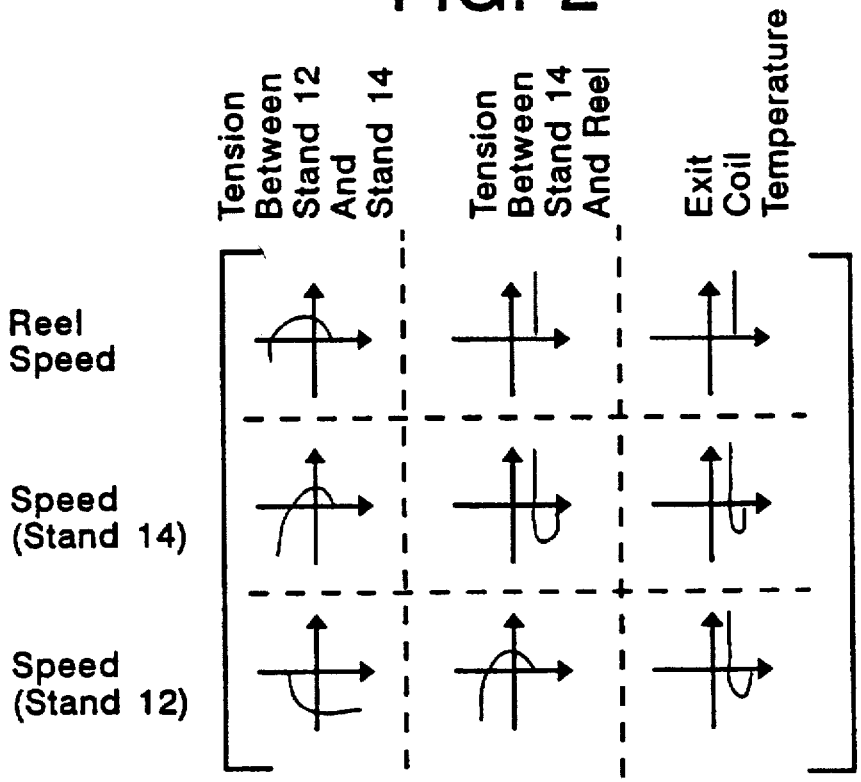
FIG. 2 is a transfer function matrix representing the interrelationships between equipment in a rolling mill in accordance with the embodiment of FIG. 1.
FIG. 3 is a graphical representation of a matrix illustrating a multivariable controller of the embodiment shown in FIG. 1.

These models can be represented in matrix form, as shown in FIG. 2. In this matrix 80, also known as a transfer function matrix, each row represents the interrelationship of each controlled variable to one of the manipulated variables. For example, in the first row 82: the first element relates the exit coil temperature measured between the last stand and the reel to the speed of the reel; the second element relates the interstand tension between the second rolling stand and the reel to the speed of the reel; and the third element relates the interstand tension measured between the first and last stands to the speed of the reel.

In the embodiment shown in FIG. 2, the measurements are performed to obtain results in the frequency domain by providing a test sinusoidal wave signal with pre-selected amplitude and frequency sweeps. These results can then be represented, for example, as Laplace transforms in the transfer function matrix. Accordingly, the transfer function matrix represents the interrelationships between the various rolling mill devices.

Transfer function matrices may also be represented graphically. As shown in FIG. 3, an array 81 of Nyquist plots with each plot being a polar graph showing gain versus phase angle over a relevant range of frequencies is such a graphical representation used in one embodiment of the subject invention.

A "decoupled" transfer function matrix, that is, where the interrelationships between the various rolling mill devices are minimized, has elements on the diagonal only. Since such decoupled relationships result in more stable and robust operations, the transfer function matrix can be manipulated to obtain a diagonally dominant matrix.

In one embodiment, this manipulation is performed by pre-multiplying the transfer function matrix with a pre-multiplier matrix. The elements of the pre-multiplier matrix can be derived by graphically manipulating the product of a pre-multiplier matrix K and the transfer function matrix G. Such manipulation can be performed most easily on a computer using publicly available software. Specifically, in a procedure known as the Inverse Nyquist Array (INA) approach, the transfer function matrix G is plotted as a Nyquist array and a pre-multiplier matrix K is set up to pre-multiply this transfer function matrix G. Initially, K is an identity matrix, and the product of K×G is equal to G. In steps, elements are inserted into the pre-multiplier matrix K, to progressively make the product K×G diagonally dominant according to well-known methods. This procedure is analogous to Gaussian reduction of a matrix to eliminate off-diagonal elements. While a purely diagonal product matrix K×G is usually not achieved, the procedure is deemed complete once sufficient diagonal dominance has been obtained, that is, the off-diagonal elements do not significantly contribute to coupling effects.

Figure 4:
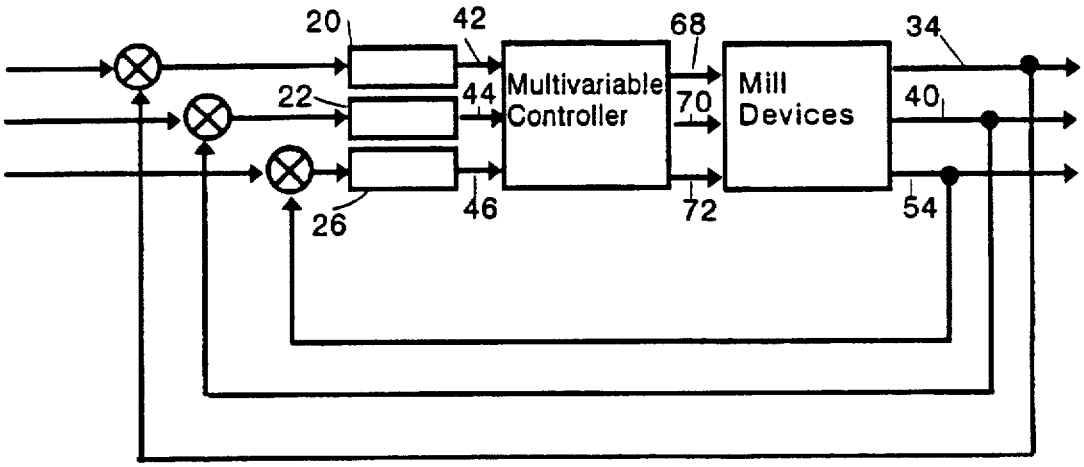
FIG. 4 is a block diagram illustrating the operation of a rolling mill in accordance with the embodiment in FIG. 1.

Since matrix G and product matrix K×G are models of the rolling mill interrelationships, programming or tuning the multivariable controller to manipulate the output drive signals 42, 44, 46 according to the pre-multiplier matrix K "decouples" the output drive signals. Specifically, in the embodiment of the present invention shown in FIG. 4 the output drive signals 40, 42, 46 are received by a multivariable controller 90 and manipulated by a pre-compensator matrix P to produce adjusted drive signals 68, 70, 72 that result in faster responses of the rolling mill to changes in the exit coil temperature and interstand tension setpoint commands. The relationship between pre-multiplier matrix K and pre-compensator matrix P is discussed below.

Figure 5:
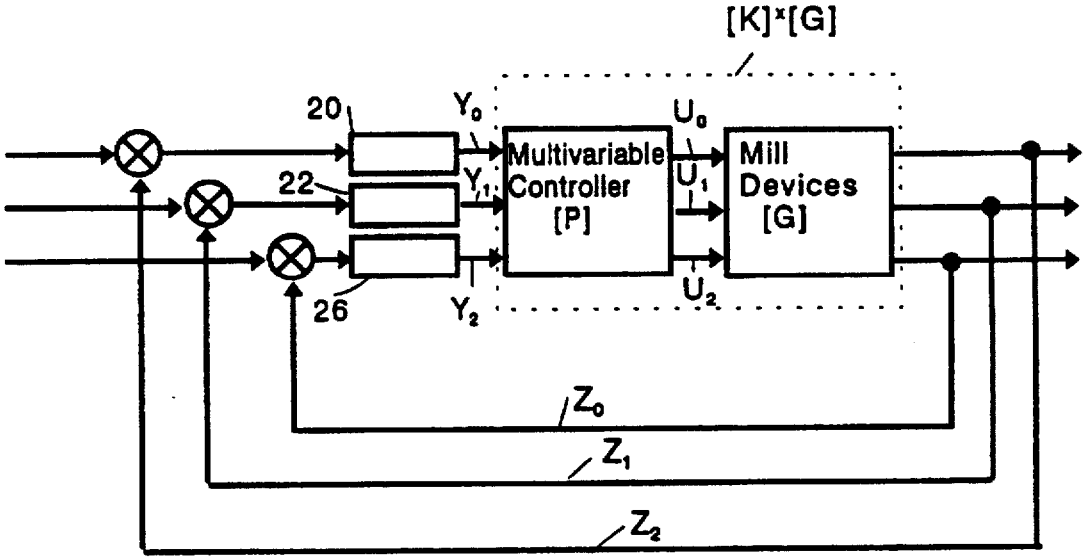
FIG. 5 is a block diagram illustrating the correspondence between the rolling mill controllers and the mathematical representations of the embodiment shown in FIG. 1.

The manipulation by the multivariable controller can be represented as shown in FIGS. 5 and 6. Mathematically, the output drive signals generated by the single variable controllers can be represented as a vector y. The product of the pre-multiplier matrix K and the transfer function matrix G pre-multiplies this vector y to produce the desired controlled variables, z. However, in operation, the actual rolling mill is used in place of matrix G and thus, no transfer function matrix G is available to be pre-multiplied to achieve diagonal dominance. Accordingly, drive signals adjusted for "diagonal dominance" for output to the various mill equipment is required. Mathematically, these adjusted drive signals can be represented by a vector u and can be generated by employing a pre-compensator matrix P. Pre-compensator matrix $P=G^{-1}\times K\times G$ and is derived as follows: (1) since $G\cdot u=z$ and $P\cdot y=u$; (2) then $G\times P\cdot y=z$ by substitution; (3) since $K\times G\cdot y=z$, then $K\times G\cdot y=G\times P\cdot y$ or $K\times G=GxP$; and (4) pre-multiplying with $G^{-1}$yields $G^{-1}\times K\times G=P$. The elements of vector u are the adjusted drive signals 68, 70, 72 which are separately received by the individual devices after being output from the multivariable controller. Rolling mills operating in accordance with this invention can adapt to commanded exit coil temperatures in less than 5 seconds in contrast to the 45 seconds of a typical rolling mill.

In one embodiment, commercially available software generates a FORTRAN program encoding the pre-compensation matrix P for execution by a digital computer acting as the multivariable controller.

Since other factors (for example, the ambient room temperature) affect the exit coil temperature and other metal strip quality parameters, this invention envisions the incorporation of other variables in pre-compensator matrices to account for these additional factors as well and thus, adjust more quickly to maintain the quality of the metal strip as such factors are changed.

In one embodiment, the multivariable controller is optimized such that the allowed regions of operation of the controllers take into account plant limitations with respect to stability and metallurgical requirements. For example, if the programming of the multivariable controller calculates that the adjusted drive signal should result in an interstand tension of 112 $Kg/cm^2$ but the metal strip is known to break at tensions above 98 $kg/cm^2$, the multivariable controller will operate to limit the adjusted drive command accordingly.

Figure 7:
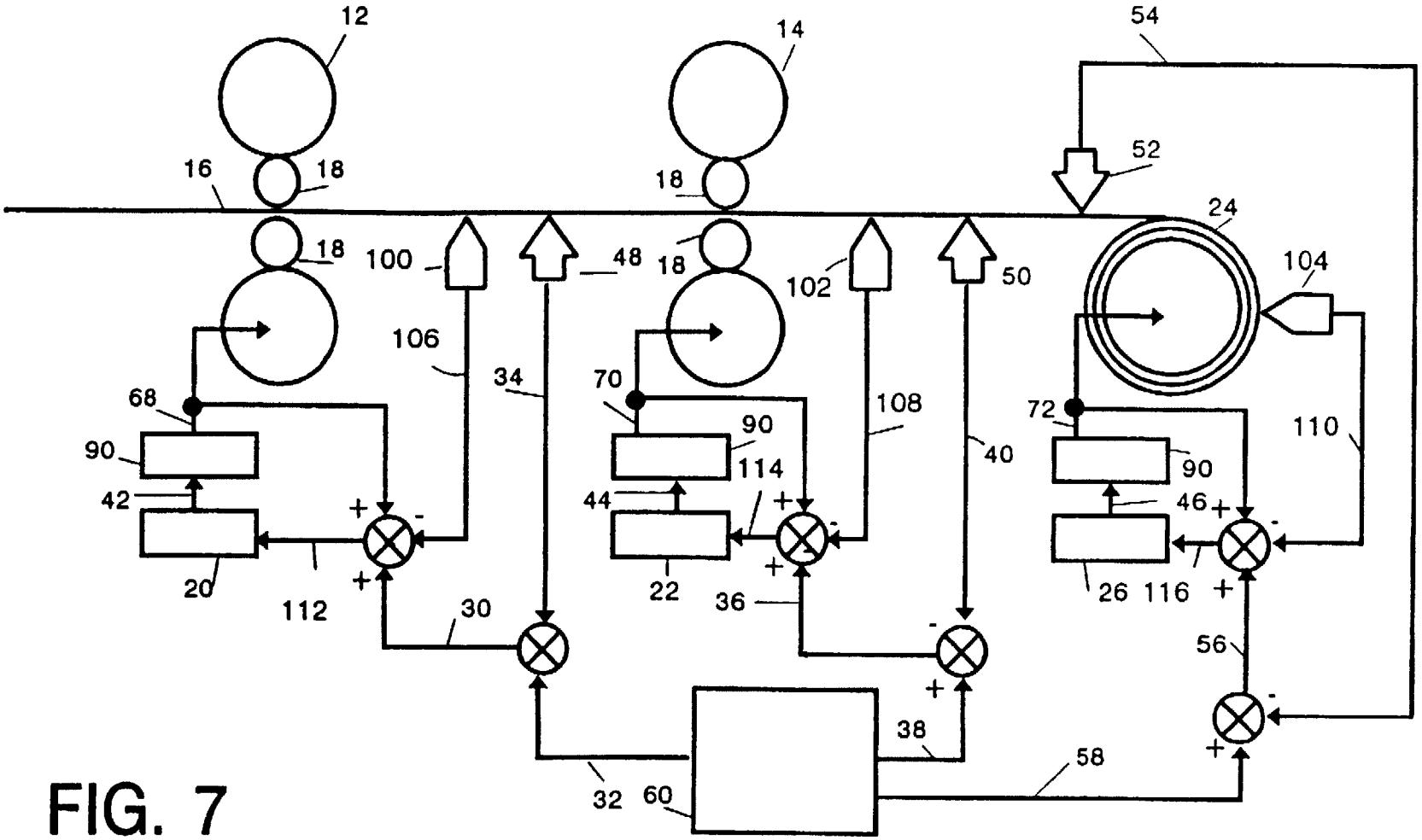
FIG. 7 illustrates a rolling mill employing single variable controllers and a multivariable controller according to a second embodiment of the subject invention.

Although this invention has been described in relation to simple control loops, more complex loops can also be used with the subject invention. FIG. 7 illustrates a rolling mill which also uses speed sensors 100, 102, 104 in the feedback loop. Specifically, the speed sensors detect the speed of the rolling stands and the coiling device and generate respective detected speed signals 106, 108, 110. Each of the detected speed signals can be differenced with the respective adjusted drive signal 68, 70, 72 to produce a respective feedback speed signal. In the rolling mill illustrated in FIG. 7, instead of respective feedback speed signals, the detected speed signals and the adjusted drive signals are differenced with the respective difference signals 30, 36, 56 at the same time to generate respective speed/tension difference signals 112, 114, 116. These speed/tension difference signals are then manipulated by the single variable controllers 20, 22, 26 and the multivariable controller 90 in a similar manner to the rolling mill illustrated in FIG. 1, except that the elements of the precompensator matrix will take into account the addition of the feedback loop information when the precompensator matrix is derived. Since the speed/tension difference signals include feedback from the speed control loop and the tension and exit coil temperature loops, the accuracy of the generated drive command signals is improved.

While each controller can be a separate computer and/or constructed as separate hardwired circuitry, the subject invention also envisions that one or more of the single variable controllers and the multivariable controller can be embodied in a single computer, can be constructed in a single hardwired circuit or combinations thereof.

Although the subject invention has been disclosed and illustrated with reference to two rolling stands and a single coiling device it should be apparent to a person of ordinary skill in the art that other and different numbers of stands and devices can be operated by the multivariable controller of the present invention without departing from its scope.

Also, it is to be understood that the invention is not limited to the features and embodiments hereinabove set forth, but may be carried out in other ways without departure from its spirit.

What is claimed is:

1. A rolling mill for processing a web of material comprising:

a plurality of devices for successively reducing the thickness of processing the web of material;

a plurality of detectors for measuring a plurality of parameters of the rolling mill operation and for generating respective detected parameter signals, including a detected interdevice tension signal measured between each of said manipulating devices and a detected temperature signal of said web of material;

a plurality of single variable controllers for generating respective drive command signals for each of said manipulating devices according to said detected parameter signals; and a multivariable controller:

(1) for receiving said drive command signals;

(2) for adjusting said drive command signals according to predetermined relationships between said detected parameter signals and said drive command signals; and (3) for outputting each of said adjusted drive command signals to a respective one of said manipulating devices.

2. A rolling mill according to claim 1, wherein said plurality of single variable controllers comprise:

a plurality of speed controllers, each speed controller generating a speed drive command signal for a respective one of said manipulating devices; and wherein said plurality of manipulating devices comprise:

a plurality of rolling stands for successively reducing a thickness of said web of material, each rolling stand operating in accordance with said respective adjusted drive command signal; and a coiling device for winding said manipulated web of material into a coil, said coiling device operating in accordance with said respective adjusted drive command signal.

3. A rolling mill according to claim 1, wherein said detected temperature signal comprises the detected temperature signal of said web of material between a last successive one of said plurality of rolling stands and said coiling device.

4. The rolling mill according to claim 1, wherein said multivariable controller further comprises an optimizer for further adjusting said drive command signals in accordance with mechanical limitations of said manipulating devices.

5. A method for controlling the temperature of a web of material at a location along the processing path of a web of material in a multistand rolling mill, the processing path having a plurality of manipulating devices which affect the interdevice tension and web of material temperature comprising the steps of:

generating a drive command signal for each manipulating device according to a setpoint command signal and a respective detected parameter signal wherein at least one of said drive command signals is generated from a web of material temperature setpoint command signal and a respective detected web of material temperature signal;

adjusting each of said drive command signals according to a predetermined relationship which relates each of said detected parameter signals to each of said drive command signals; and outputting each of said adjusted drive command signals to a respective one of the manipulating devices.

6. A method for maximizing the decoupling of the interrelationships between devices in a multistand rolling mill comprising steps of:

determining elements of a transfer function matrix having rows and columns for modelling the operation of the multistand rolling mill, each row comprising elements that relate a plurality of detected controlled parameter signals to one of a plurality of generated manipulated parameter signals;

manipulating said transfer function matrix to generate a diagonally dominant transfer function matrix;

generating a pre-multiplier matrix from said diagonally dominant transfer function matrix; and encoding said pre-multiplier matrix in a multivariable controller; said multivariable controller adjusting respective drive commands for each device to decouple the interrelationships between the devices.

7. A method for maximizing the decoupling according to claim 6, wherein said step of determining the elements of said transfer function comprises the steps of:

gathering data for each element of said transfer function matrix by varying one of said manipulated parameter signals while keeping other manipulated parameter signals constant and measuring the effect of the variation on said controlled parameter signals; and generating a model of a relationship between each of said manipulated parameter signals and each of said controlled parameter signals.

8. A method for maximizing the decoupling according to claim 6, wherein after the step of encoding the said pre-multiplier matrix, the method further comprises a step of:

optimizing allowed regions of operation of each device in accordance with physical limitations of each device.

9. A control system for a rolling mill which processes a web of material comprising:

a plurality of detectors for measuring a plurality of parameters of the rolling mill operation and for generating respective detected parameter signals, including a detected interdevice tension signal measured between each of said manipulating devices and a detected temperature signal of said web of material;

a plurality of single variable controllers for generating respective drive command signals according to said detected parameter signals; and a multivariable controller: (1) for receiving said drive command signals; (2) for adjusting said drive command signals according to predetermined relationships between said detected parameter signals and said drive command signals; and (3) for outputting each of said adjusted drive command signals.

10. A rolling mill for processing a web of material comprising:

a plurality of devices for successively reducing the thickness of processing the web of material;

a plurality of detectors for measuring a plurality of parameters of the rolling mill operation and for generating respective detected parameter signals;

a plurality of single variable controllers for generating respective drive command signals for each of said manipulating devices according to said detected parameter signals; and a multivariable controller: (1) for receiving said drive command signals; (2) for adjusting said drive command signals according to predetermined relationships between said detected parameter signals and said drive command signals; and (3) for outputting each of said adjusted drive command signals to a respective one of said manipulating devices, wherein said predetermined relationships comprise a diagonally dominant matrix having rows and columns, each row comprising a plurality of elements representing respective relationships between one of said plurality of drive command signals and each of said detected parameter signals.

* * * * *